US009421671B2

(12) United States Patent
Rupp et al.

(10) Patent No.: US 9,421,671 B2
(45) Date of Patent: Aug. 23, 2016

(54) INFILTRATED DIAMOND WEAR RESISTANT BODIES AND TOOLS

(75) Inventors: Michael D. Rupp, Murray, UT (US); Cody A. Pearce, Midvale, UT (US); Christian M. Lambert, Draper, UT (US)

(73) Assignee: LONGYEAR TM, INC., Salt Lake City, UT (US)

( * ) Notice: Subject to any disclaimer, the term of this patent is extended or adjusted under 35 U.S.C. 154(b) by 486 days.

(21) Appl. No.: 13/368,928

(22) Filed: Feb. 8, 2012

(65) Prior Publication Data

US 2012/0199402 A1 Aug. 9, 2012

Related U.S. Application Data

(60) Provisional application No. 61/441,189, filed on Feb. 9, 2011.

(51) Int. Cl.

| | |
|---|---|
| ***E21B 10/46*** | (2006.01) |
| ***B24D 99/00*** | (2010.01) |
| ***B24D 3/06*** | (2006.01) |
| ***B24D 7/06*** | (2006.01) |
| ***E21B 10/48*** | (2006.01) |

(52) U.S. Cl.
CPC ..... *B24D 99/005* (2013.01); *B24D 3/06* (2013.01); *B24D 7/06* (2013.01); *E21B 10/46* (2013.01); *E21B 10/48* (2013.01)

(58) Field of Classification Search
CPC .... E21B 10/46; E21B 10/55; E21B 2010/561
USPC ..... 175/405.1, 420.2, 434; 428/325, 408, 428/469, 698
See application file for complete search history.

(56) References Cited

U.S. PATENT DOCUMENTS

| | | | | |
|---|---|---|---|---|
| 3,306,380 A | | 2/1967 | Warren | 175/330 |
| 4,604,106 A | * | 8/1986 | Hall | 51/293 |
| 4,630,692 A | * | 12/1986 | Ecer | 175/405.1 |
| 5,178,645 A | * | 1/1993 | Nakamura et al. | 51/293 |
| 5,304,342 A | * | 4/1994 | Hall et al. | 419/11 |

(Continued)

FOREIGN PATENT DOCUMENTS

| | | |
|---|---|---|
| AU | 2012214291 | 9/2013 |
| CA | 2826758 | 8/2012 |

(Continued)

OTHER PUBLICATIONS

International Search Report and Written Opinion mailed Sep. 24, 2012 for International Patent Application No. PCT/US2012/024539, which was filed on Feb. 9, 2012 and published as WO 2012/109479 [Applicant—Longyear TM, Inc.: Inventors—Rupp et al.;] [9 pages].

(Continued)

*Primary Examiner* — Cathleen Hutchins
(74) *Attorney, Agent, or Firm* — Ballard Spahr LLP

(57) ABSTRACT

Implementations of the present invention include infiltrated diamond tools with increased wear resistance. In particular, one or more implementations of the present invention include a body comprising at least 10% by volume diamond particles that are infiltrated with a binder. Implementations of the present invention also include drilling systems including such infiltrated diamond tool, and methods of forming and using such infiltrated diamond tools.

23 Claims, 7 Drawing Sheets

(56) References Cited

U.S. PATENT DOCUMENTS

| | | | | |
|---|---|---|---|---|
| 6,214,079 | B1 | 4/2001 | Kear | 75/230 |
| 6,951,578 | B1 | 10/2005 | Belnap et al. | |
| 7,628,228 | B2 | 12/2009 | Drivdahl | 175/58 |
| 7,695,542 | B2 | 4/2010 | Drivdahl | 75/229 |
| 8,517,125 | B2 | 8/2013 | Lockwood | 175/425 |
| 2004/0159471 | A1 | 8/2004 | Azar et al. | |
| 2005/0263328 | A1* | 12/2005 | Middlemiss | 175/434 |
| 2007/0102199 | A1 | 5/2007 | Smith et al. | |
| 2008/0029310 | A1 | 2/2008 | Stevens et al. | |
| 2008/0128170 | A1 | 6/2008 | Drivdahl | 75/229 |
| 2008/0282618 | A1* | 11/2008 | Lockwood | 51/295 |
| 2010/0193254 | A1 | 8/2010 | Lind et al. | |
| 2010/0218999 | A1 | 9/2010 | Jones et al. | |
| 2011/0031037 | A1* | 2/2011 | Bellin et al. | 175/430 |
| 2012/0056022 | A1 | 3/2012 | Lyons et al. | |

FOREIGN PATENT DOCUMENTS

| | | | |
|---|---|---|---|
| CN | 2521375 | | 11/2002 |
| CN | 103459751 | | 12/2013 |
| EP | 0312487 | A1 | 4/1989 |
| EP | 0733776 | | 9/1996 |
| EP | 0733776 | A2 | 9/1996 |
| EP | 2673454 | | 12/2013 |
| EP | 2673454 | A2 | 12/2013 |
| PE | 06032014 | | 5/2014 |
| WO | WO 2012/109479 | | 8/2012 |
| WO | WO-2012/0109479 | A2 | 8/2012 |
| ZA | 2013/06742 | | 11/2014 |

OTHER PUBLICATIONS

International Preliminary Report on Patentability mailed Aug. 13, 2013 for International Patent Application No. PCT/US2012/024539, which was filed on Feb. 9, 2012 and published as WO 2012/109479 [Applicant—Longyear TM, Inc.; Inventors—Rupp et al.;] [6 pages].

International Search Report and Written Opinion of the International Searching Authority issued on Aug. 21, 2015 for international application PCT/US2015/030535, filed on May 13, 2014 (Applicant—Longyear TM, Inc. // Inventor—Pearce, et al.) (19 pages).

* cited by examiner

INFILTRATED DIAMOND WEAR RESISTANT BODIES AND TOOLS

CROSS-REFERENCE TO RELATED APPLICATIONS

This application claims the benefit of U.S. Provisional Application No. 61/441,189, filed Feb. 9, 2011, entitled "Infiltrated Diamond Wear Resistant Drilling Tools," the contents of which are hereby incorporated by reference in their entirety.

BACKGROUND OF THE INVENTION

1. The Field of the Invention

The present invention generally relates to tools, such as drilling, mining, and industrial tools. More particularly, the present invention relates to wear resistant tools and to methods of making and using such tools.

2. Discussion of the Relevant Art

Many drilling, mining, and industrial tools include bodies or pads formed from tungsten carbide (WC) or other wear resistant materials to provide wear resistance and increased tool life. For example, many types of earth-boring tools (such as drill bits and reamers) include a bit body which may be made of steel or fabricated from a hard matrix material such as tungsten carbide (WC). In some cases, a plurality of cutters (e.g., PCD, TSD, surface sets) is mounted along the exterior face of the bit body. The cutters are positioned so that, as the bit body rotates, the cutters engage and drill the formation. Alternatively, the body can comprise the cutter such as with impregnated drill bits.

During drilling the bit bodies of such earth-boring tools can be exposed to high-velocity drilling fluids and formation fluids which carry abrasive particles, such as sand, rock cuttings, and the like. Such abrasive particles can wear down the bit bodies of the earth boring tools, resulting in lost cutters or even failure of the body.

While steel body bits may have toughness and ductility properties which make them resistant to cracking and failure due to impact forces generated during drilling, steel is more susceptible to erosive wear. Tungsten carbide or other hard metal matrix body bits have the advantage of higher wear and erosion resistance as compared to steel bodies. Bodies formed from tungsten carbide or other hard metal matrix materials; however, can lack toughness and strength. Thus, bodies formed from tungsten carbide or other hard metal matrix materials can be relatively brittle and prone to cracking when subjected to impact and fatigue forces that may be encountered during drilling. This can result premature failure of the body. The formation and propagation of cracks in the matrix body may result in the loss of one or more cutters. A lost cutter may abrade against the body, causing further accelerated damage. Furthermore, even tungsten carbide bodies are subject to wear and eventually need to be replaced.

Bodies formed with sintered tungsten carbide may have sufficient toughness and strength for a particular application, but may lack other mechanical properties, such as erosion resistance. Thus, previous efforts have relied on combinations of materials to achieve a balance of properties. Additionally, use of materials having wide particle size distributions have been relied upon so as to achieve a close packing of the carbide wear particles to increase wear resistance.

Other types of drilling tools, such as reamers, drill string stabilizers, wear pads, etc. are susceptible to wear during use. It is common to set carbide or diamond elements in such tools to increase wear resistance and maintain the gauge of the tool.

The setting of carbide or diamond elements in such tools can be difficult and can otherwise increase manufacturing time and costs. Furthermore, locations not covered by these elements are still subject to relatively rapid wear.

Percussive drilling tools are often formed from high strength steel bodies. The high strength steel bodies provide the percussive drilling tools with the ductility to be subject to high shock and percussive forces during drilling. Such high strength steel bodies; however, do not have particularly high wear resistance.

In addition to the foregoing, wear resistant pads or other components are frequently added to high wear areas of earth-moving tools and machines, mining tools, and industrial tools that contact abrasive materials, such as rock. For instance, hard facing WC is often added to teeth on front-loader buckets and other tools. Commonly, such wear pads are formed from tungsten carbide to provide superior wear resistance compared to steel. Unfortunately, wear pads can also experience some of the problems discussed above. For example, conventional wear pads can be relatively brittle and prone to cracking when subjected to impact and fatigue forces.

Accordingly, there exists a need for a new composition for tools to increase resistance to wear, while also maintaining other properties such as high strength and toughness.

BRIEF SUMMARY OF THE INVENTION

Implementations of the present invention overcome one or more of the foregoing or other problems in the art with tools, systems, methods including bodies or substrates formed from infiltrated diamond. In particular, one or more implementations of the present invention include a body comprising infiltrated diamond with a binder. The infiltrated diamond can provide the body with increased wear resistance over steel and tungsten carbide bodies. Additionally, the infiltrated diamond can provide the body with increased ductility compared to tungsten carbide and other cermet bodies. Furthermore, the infiltration process can allow for a wide variety of body shapes.

For example, an implementation of tool that is resistant to wear includes an infiltrated diamond body. The infiltrated diamond body includes a plurality of diamond particles. The diamond particles comprise at least 25 percent by volume of the infiltrated diamond body. The tool further includes a binder securing the diamond particles together.

Another implementation of the present invention includes a method of forming a wear resistant tool. The method involves preparing a matrix by dispersing a plurality of diamond particles throughout a hard particulate material. The diamond particles comprise at least 25 percent by volume of the matrix. The method further involves shaping the matrix into a desired shape and infiltrating the matrix with a binder material.

In addition to the foregoing, an implementation of a drilling tool includes a body having a first end and a second end. The first end of the body includes a threaded connector. The tool also includes an infiltrated diamond body secured to the body. The infiltrated diamond body comprises diamond and a binder. The diamond comprises at least 10% by volume of the infiltrated diamond body. Additionally, the binder is configured to prevent erosion of the infiltrated diamond body during drilling.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
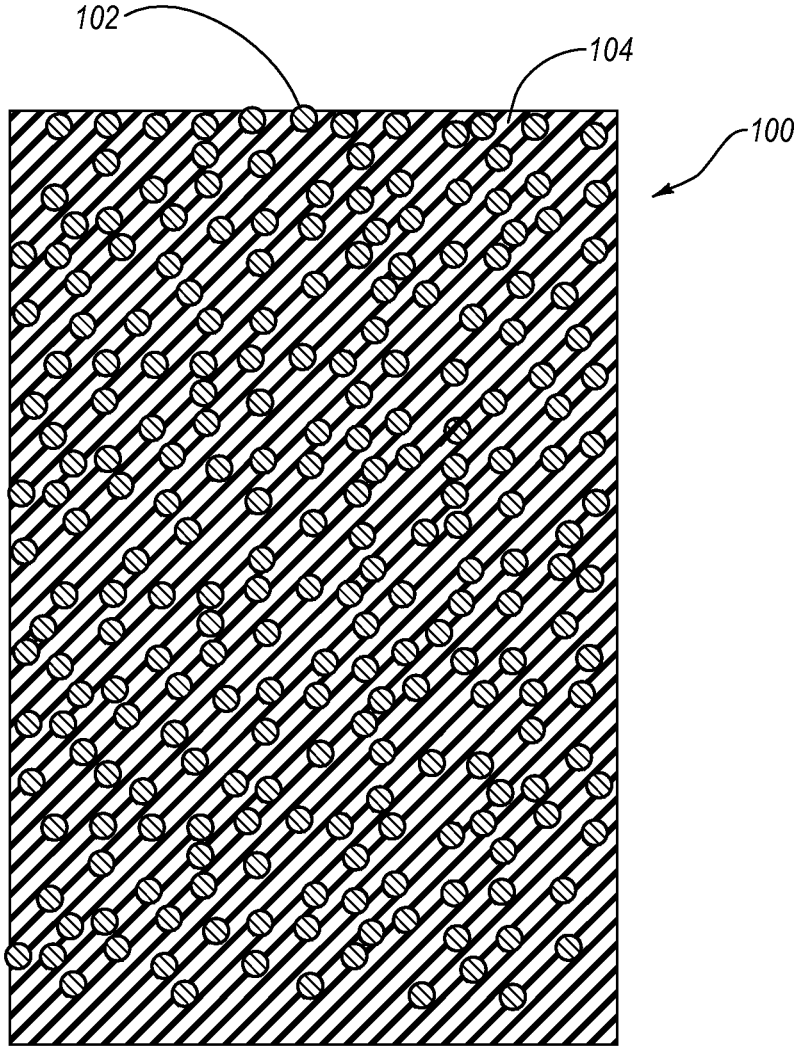
FIG. 1 illustrates a cross-sectional view of an infiltrated diamond body according to an implementation of the present invention.

Implementations of the present invention are directed towards tools, systems, methods including bodies or substrates formed from infiltrated diamond. In particular, one or more implementations of the present invention include a body comprising infiltrated diamond with a binder. The infiltrated diamond can provide the body with increased wear resistance over steel and tungsten carbide bodies. Additionally, the infiltrated diamond can provide the body with increased ductility compared to tungsten carbide and other cermet bodies. Furthermore, the infiltration process can allow for a wide variety of body shapes.

In other words, one or more implementations of the present invention can replace tungsten carbide powders or other cermets used in manufacture of wear resistant substrates or hardfacing with infiltrated diamond as the primary wear resistant material. The synthetic diamond can provide the significant advantage of having a Mohs hardness of 10, which is a 5× increase in absolute hardness over the next hardest cermet. Furthermore, one or more implementations use the infiltration of diamond to create almost any shape of body or substrate. Thus, one or more implementations of the present invention can replace hard steel bodies that are used in shapes that cermets cannot be manufactured into or have insufficient ductility for the shock loading. Furthermore, the binder can be tailored to achieve the required ductility for a particular application. In addition to the foregoing, the use of high diamond concentrations can preclude the need for hand set wear elements.

In particular, one or more implementations include infiltrated diamond bodies. The infiltrated diamond bodies can comprise diamond particles. The diamond particles can include one or more of natural diamonds, synthetic diamonds, polycrystalline diamond products (i.e., TSD or PCD), etc. The diamond particles can comprise anywhere from about 10% to about 95% volume of the infiltrated diamond body. In one or more implementations, the diamond particles can comprise the primary component of the infiltrated diamond body by volume, and thus, the primary defense against wear and erosion of the infiltrated diamond body.

Infiltrated diamond bodies of one or more implementations can form at least a portion of any number of different tools, particularly tools that have need for wear resistance. For example, the infiltrated diamond bodies can be part of tools used to cut or otherwise interface with stone, subterranean mineral formations, ceramics, asphalt, concrete, and other hard materials. These tools may include, for example, drilling tools such as core sampling drill bits, drag-type drill bits, roller cone drill bits, diamond wire, grinding cups, diamond blades, tuck pointers, crack chasers, reamers, stabilizers, drill rods, wear strips and pads, and the like. For example, the drilling tools may be any type of earth-boring drill bit (i.e., core sampling drill bit, drag drill bit, roller cone bit, navi-drill, full hole drill, hole saw, hole opener, etc.), and so forth. The Figures and corresponding text included hereafter illustrate examples of drilling tools including infiltrated diamond bodies, and methods of forming and using such tools. This has been done for ease of description. One will appreciate in light of the disclosure herein; however, that the systems, methods, and apparatus of the present invention can be used with other tools.

For example, implementations of the present invention can be used to form any type of tool that requires high wear resistance. Such tools can include mining, construction, farming, medical (e.g., hip or other replacements), and other industrial tools, dies, and gauging. Additionally, the infiltrated diamond bodies can be used in wear and shock applications such as percussive bits, down-the-hole hammers and bits, sonic bits, etc. In one or more implementations, the infiltrated diamond bodies can replace tungsten carbide hardfacing. Thus, one will appreciate in light of the disclosure herein that the infiltrated diamond bodies can form part of, or be attached to dozer blades, grader blades, machine undercarriage parts, bucket teeth, grader scrappers, bucket liners, mixer blades, wear plates, tunneling tools, augers, edges of molding screws, pulverizer mill scrappers, stabilizers, crushing hammers, teeth of dredging bits, cutter teeth, wear parts for farming tools, feeding screws, extrusion dies, screws, or other tools or machines.

Referring now to the Figures, FIG. 1 illustrates a cross-sectional view of an infiltrated diamond body 100 in accordance with one or more implementations of the present invention. As shown in FIG. 1, the infiltrated diamond body 100 can comprise diamond 102 held together by a binder 104. One will appreciate in light of the disclosure herein, that the diamond 102 can replace a powered metal or alloy, such as tungsten carbide used in many conventional tools. Alternatively, the infiltrated diamond body 100 can replace a steel body or component in a conventional tool. In still further implementations, the infiltrated diamond body 100 can replace tungsten carbide hardfacing.

The diamond 102 can comprise one or more of natural diamonds, synthetic diamonds, polycrystalline diamond products (i.e., TSD or PCD), etc. The diamond 102 can comprise a wide number sizes, shapes, grain, quality, grit, concentration, etc. as explained in greater detail below. In any event, the diamond 102 can comprise at least about 10% volume of the infiltrated diamond body 100. For example, the diamond 102 can comprise between about 25% and about 95% volume of the infiltrated diamond body 100. In one or more implementations, the diamond 102 can comprise the primary component of the infiltrated diamond body 100. In other words, the percent volume of the diamond 102 can be greater than percent volume any of the other individual components (binder 104, hard particulate material etc.) of the infiltrated diamond body 100. Thus, the diamond 102 can form the primary defense against wear and erosion of the infiltrated diamond body 100.

More specifically, in one or more implementations the diamond 102 can comprise between about 30% and 90% by volume of the infiltrated diamond body 100. In further implementations, the diamond 102 can comprise between about 35% and 75% by volume of the infiltrated diamond body 100. In still further implementations, the diamond 102 can comprise about 10%, 15%, 20%, 25%, 30%, 35%, 40%, 45%, 50%, 55%, 60%, 65%, 70%, 75%, 80%, 85%, or 90% by volume of the infiltrated diamond body 100. Recitation of ranges of values herein are merely intended to serve as a shorthand method of referring individually to each separate value falling within the range, unless otherwise indicated herein, and each separate value is incorporated into the specification as if it were individually recited herein.

In one or more implementations, the diamond 102 can be homogenously dispersed throughout the infiltrated diamond body 100. In alternative implementations, however, the concentration of diamond 102 can vary throughout the infiltrated diamond body 100, as desired. Indeed, as explained below the concentration of diamond 102 can vary depending upon the desired characteristics for the infiltrated diamond body 100. For example, a large concentration of diamond 102 can be placed in portions of the infiltrated diamond body 100 particularly susceptible to wear, such as the outer surfaces. The size, density, and shape of the diamond 102 can be provided in a variety of combinations depending on desired cost and performance of the infiltrated diamond body 100. For example, the infiltrated diamond body 100 can comprise sections, strips, spots, rings, or any other formation that contains a different concentration or mixture of diamond than other parts of the infiltrated diamond body 100. For instance, the outer portion of the infiltrated diamond body 100 may contain a first concentration of diamond 102, and the concentration of diamond 102 can gradually decrease or increase towards inner portion of the infiltrated diamond body 100.

In one or more implementations the diamond 102 comprises particles, such as natural diamond crystals or synthetic diamond crystals. The diamond 102 can thus be relatively small. In particular, in one or more implementation, the diamond 102 has a largest dimension less than about 2 millimeters, or more preferably between about 0.01 millimeters and about 1.0 millimeters. Additionally or alternatively, a volume that is less between about 0.001 $mm^3$ and about 8 $mm^3$. In alternative implementations, the diamond 102 can have a largest dimension more than about 2 millimeters and/or a volume more that about 8 $mm^3$.

In one or more implementations, the diamond 102 can include a coating of one or more materials. The coating can include metal, ceramic, polymer, glass, other materials or combinations thereof. For example, the diamond 102 can be coated with a metal, such as iron, titanium, nickel, copper, molybdenum, lead, tungsten, aluminum, chromium, or combinations or alloys thereof. In other implementations, diamond 102 may be coated with a ceramic material, such as SiC, SiO, Si02, or the like.

The coating may cover all of the surfaces of the diamond 102, or only a portion thereof. Additionally, the coating can be of any desired thickness. For example, in one or more implementations, the coating may have a thickness of about one to about 20 microns. The coating may be applied to the diamond 102 through spraying, brushing, electroplating, immersion, vapor deposition, or chemical vapor deposition. The coating can help bond the diamond 102 to the binder or hard particulate material. Still further, or alternatively, the coating can increase or otherwise modify the wear properties of the diamond 102.

In yet further implementations, the infiltrated diamond body 100 can also comprise a traditional hard particulate material in addition to the diamond 102. For example, the infiltrated diamond body 100 can comprise a powered material, such as for example, a powered metal or alloy, as well as ceramic compounds. According to one or more implementations of the present invention the hard particulate material can include tungsten carbide. As used herein, the term "tungsten carbide" means any material composition that contains chemical compounds of tungsten and carbon, such as, for example, WC, W2C, and combinations of WC and W2C. Thus, tungsten carbide includes, for example, cast tungsten carbide, sintered tungsten carbide, and macrocrystalline tungsten. According to additional or alternative implementations of the present invention, the hard particulate material can include carbide, tungsten, iron, cobalt, and/or molybdenum and carbides, borides, alloys thereof, or any other suitable material.

One will appreciate in light of the disclosure herein that the amounts of the various components of infiltrated diamond body 100 can vary depending upon the desired properties. In one or more implementations, the hard particulate material can comprise between about 0% and about 55% by volume of the infiltrated diamond body 100. More particularly, the hard particulate material can comprise between about 25% and about 60% by volume of the infiltrated diamond body 100.

The diamond 102 (and hard particulate material if included) can be infiltrated with a binder 104 as mentioned previously. In one or more implementations the binder material can be a copper-based infiltrant. The binder 104 can function to bind or hold the diamond particles or crystals together. The binder can be tailored to provide the infiltrated diamond body 100 with several different characteristics that can increase the useful life and/or the wear resistance of the infiltrated diamond body 100. For example, the composition or amount of binder in the infiltrated diamond body 100 can be controlled to vary the ductility of the infiltrated diamond body 100. In this way, the infiltrated diamond body 100 may be custom-engineered to possess optimal characteristics for specific materials or uses.

The binder can comprise between about 5% and about 75% by volume of the infiltrated diamond body 100. More particularly, the binder can comprise between about 20% and about 45% by volume of the infiltrated diamond body 100. For example, a binder 104 of one or more implementations of the present invention can include between about 20% and about 45% by weight of copper, between about 0% and about 5% by weight of nickel, between about 0% and about 20% by weight of silver, between about 0% and about 0.2% by weight of silicon, and between about 0% and about 21% by weight of zinc. Alternatively, the binder 104 can comprise a high-strength, high-hardness binder such as those disclosed in U.S. patent application Ser. No. 13/280,977, the entire contents of which are hereby incorporated by reference in their entirety. In one or more implementations, such high-strength, high-hardness binders can allow for a smaller percentage by volume of diamond, while still maintaining increased wear resistance.

One or more implementations of the present invention are configured to provide tools that are wear resistance. In particular, in one or more implementations such tools are configured to also resist wear break-up and erosion. For example, in one or more implementations, the binder is configured to prevent erosion of the infiltrated diamond body during drilling. One will appreciate in light of the disclosure here that this is in contrast to impregnated tools that are configured to erode to expose new diamond during a drilling process.

Figure 2:
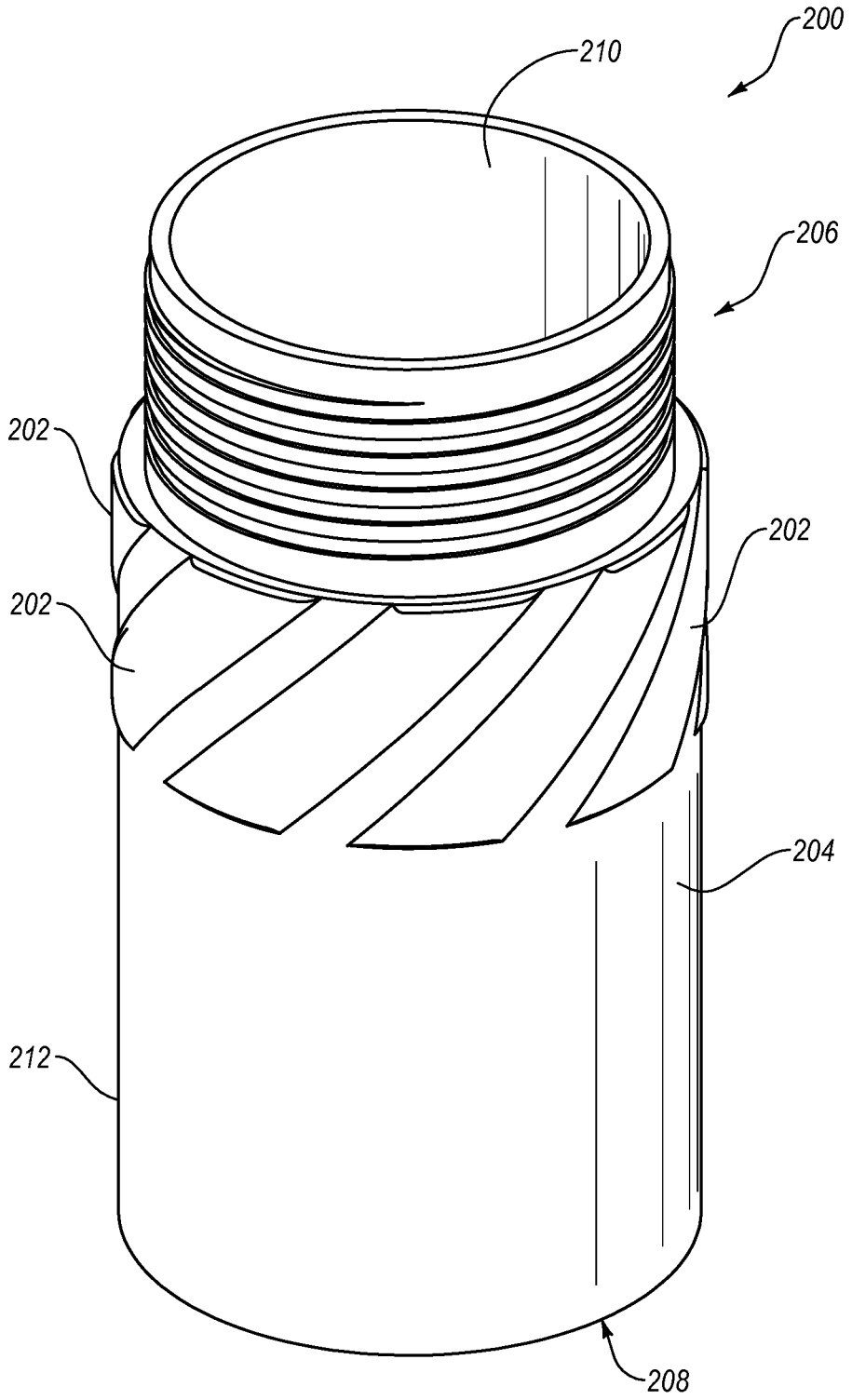
FIG. 2 illustrates a reamer including an infiltrated diamond body in accordance with one or more implementations of the present invention.

As mentioned previously, infiltrated diamond bodies 100 according to one or more implementations of the present invention can form at least part of various different tools. For example, FIG. 2 illustrates a reaming shell 200 that can include one or more infiltrated diamond bodies 100. The reaming shell 200 can also include a first or shank portion 204 with a first end 208 that is configured to connect the reaming shell 200 to a component of a drill string. For example, the first end 208 can include a female threaded connector for coupling with another drill string component. An opposing or second end 206 of the reaming shell 200 can also be configured to connect the reaming shell 200 to a component of a drill string. As shown by FIG. 2, the second end 206 can include a male threaded connector.

By way of example and not limitation, the shank portion 204 may be formed from steel, another iron-based alloy, or any other material that exhibits acceptable physical properties. As shown in FIG. 2, the reaming shell 200 a generally annular shape defined by an inner surface 210 and an outer surface 212. Thus, the reaming shell 200 can define an interior space about its central axis for receiving a core sample or allowing fluid to pass there through. Accordingly, pieces of the material being drilled can pass through the interior space of the reaming shell 200 and up through an attached drill string. The reaming shell 200 may be any size, and therefore, may be used to collect core samples of any size. While the reaming shell 200 may have any diameter and may be used to remove and collect core samples with any desired diameter, the diameter of the reaming shell 200 can range in some implementations from about 1 inch to about 12 inches.

As shown by FIG. 2, in one or more implementations, the reaming shell 200 can include raised pads 202 separated by channels. The raised pads 202 can comprise infiltrated diamond bodies 100 as described herein above. In one or more implementations the pads 202 can have a spiral configuration. In other words, the pads 202 can extend axially along the shank 204 and radially around the shank 204. The spiral configuration of the pads 202 can provide increased contact with the borehole, increased stability, and reduced vibrations. In alternative implementations, the pads 202 can have a linear instead of a spiral configuration. In such implementations, the pads 202 can extend axially along the shank 204. Furthermore, in one or more implementations the pads 202 can include a tapered leading edge to aid in moving the reaming shell 200 down the borehole.

In at least one implementation, the reaming shell 200 may not include pads 202. For example, the reaming shell 200 can include broaches formed from infiltrated diamond bodies 100 instead of pads. The broaches can include a plurality of strips. The broaches can reduce the contact of the reaming shell 200 on the borehole, thereby decreasing drag. Furthermore, the broaches can provide for increased water flow, and thus, may be particularly suited for softer formations.

Figure 3:
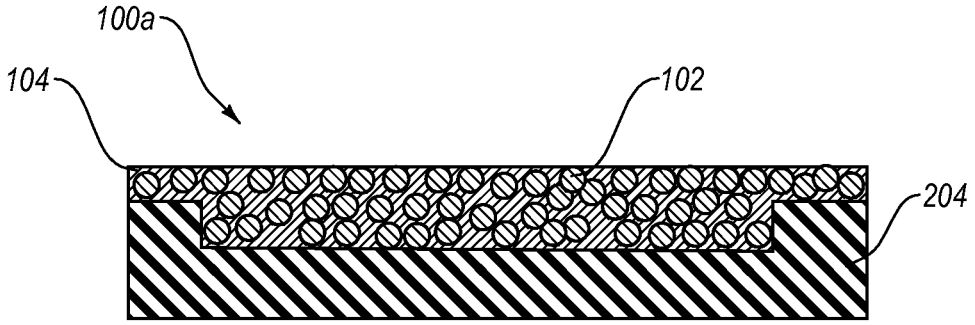
FIG. 3 illustrates a cross-sectional view of an infiltrated diamond body attached as a substrate to a tool in accordance with one or more implementations of the present invention.

In addition to comprising bodies such as pads 202, the infiltrated diamond bodies 100 can be configured as substrates that line or coat various features of a tool. For example, in one or more implementations the shank 204 of the reaming shell 200 can comprise an outer substrate or layer formed from an infiltrated diamond body 100. For example, FIG. 3 illustrates an infiltrated diamond body 100*a* configured as a substrate. The infiltrated diamond body or substrate 100*a* can comprise diamond 102, a binder 104, and optionally a hard particulate material as described above. The infiltrated diamond body or substrate 100*a* can be attached to the shank 204 of the reaming shell 200 to increase the wear resistance of the shank 204. For example, the shank 204 can comprise steel or another suitable material and the infiltrated diamond body or substrate 100*a* can be brazed or soldered to the shank 204. Alternatively or additionally, the infiltrated diamond body or substrate 100*a* can be mechanically secured to the shank 204. FIG. 3 illustrates the infiltrated diamond body or substrate 100*a* secured to a reaming shell shank 204. One will appreciate in light of the disclosure herein that the infiltrated diamond body or substrate 100*a* can be secured to any portion of the tools described herein above to increase the wear resistance thereof.

Figure 4:
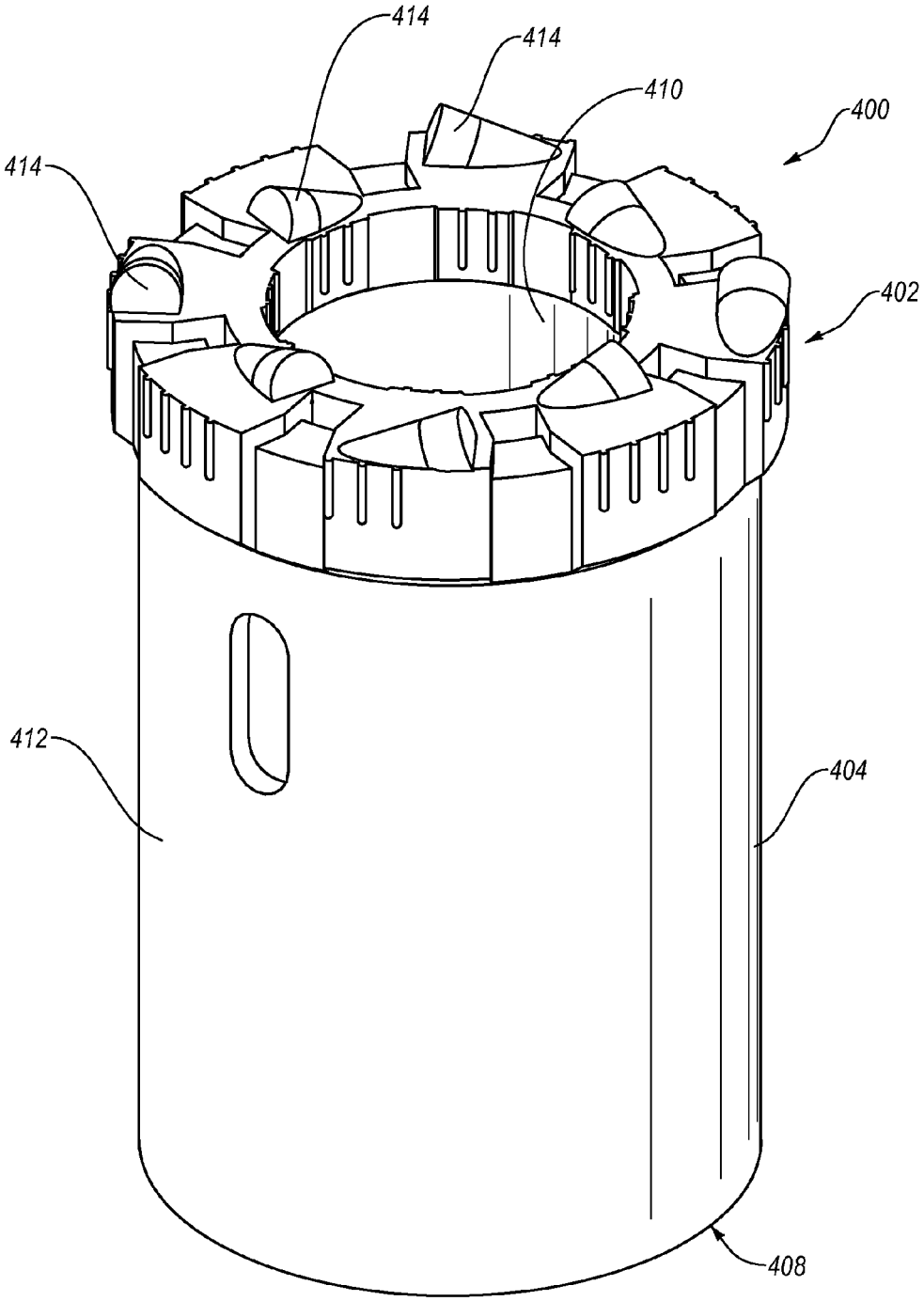
FIG. 4 illustrates a polycrystalline diamond ("PCD") core drill bit including an infiltrated diamond body in accordance with one or more implementations of the present invention.

One will appreciate in light of the disclosure herein that reaming shells 200 are only one type of tool with which infiltrated diamond bodies 100 of the present invention may be used. For example, FIG. 4 illustrates a drill bit 400 including one or more infiltrated diamond bodies 100, 100*a*. Similar to the reaming shell 200, the drill bit 400 can include a shank portion 404 with a first end 408 configured to connect to a component of a drill string. Also, the drill bit 400 can have a generally annular shape defined by an inner surface 410 and an outer surface 412. Alternatively, the drill bit 400 may not configured as a core drill bit, and thus, not have an annular shape.

The crown 402 can comprise an infiltrated diamond body 100 as described above. Furthermore, the crown 402 can include a plurality of cutters 414. Thus, the infiltrated diamond body forming the crown 402 can be configured to hold cutters 414. The cutters 414 can be brazed or soldered to the crown 402 using a binder, braze, or solder. The cutters 414 can comprise one or more of natural diamonds, synthetic diamonds, polycrystalline diamond products (i.e., TSD or PCD), aluminum oxide, silicon carbide, silicon nitride, tungsten carbide, cubic boron nitride, alumina, seeded or unseeded sol-gel alumina, or other suitable materials. In the illustrated implementation, the cutters 414 comprise PCD. The cutters 414 can be configured to cut or drill the desired materials during the drilling process. Similar to the shank 204 of the reamer 200, in one or more implementations the shank 404 can have an infiltrated diamond body or substrate 100*a* secured thereto to increase the wear resistance thereof.

Figure 5:
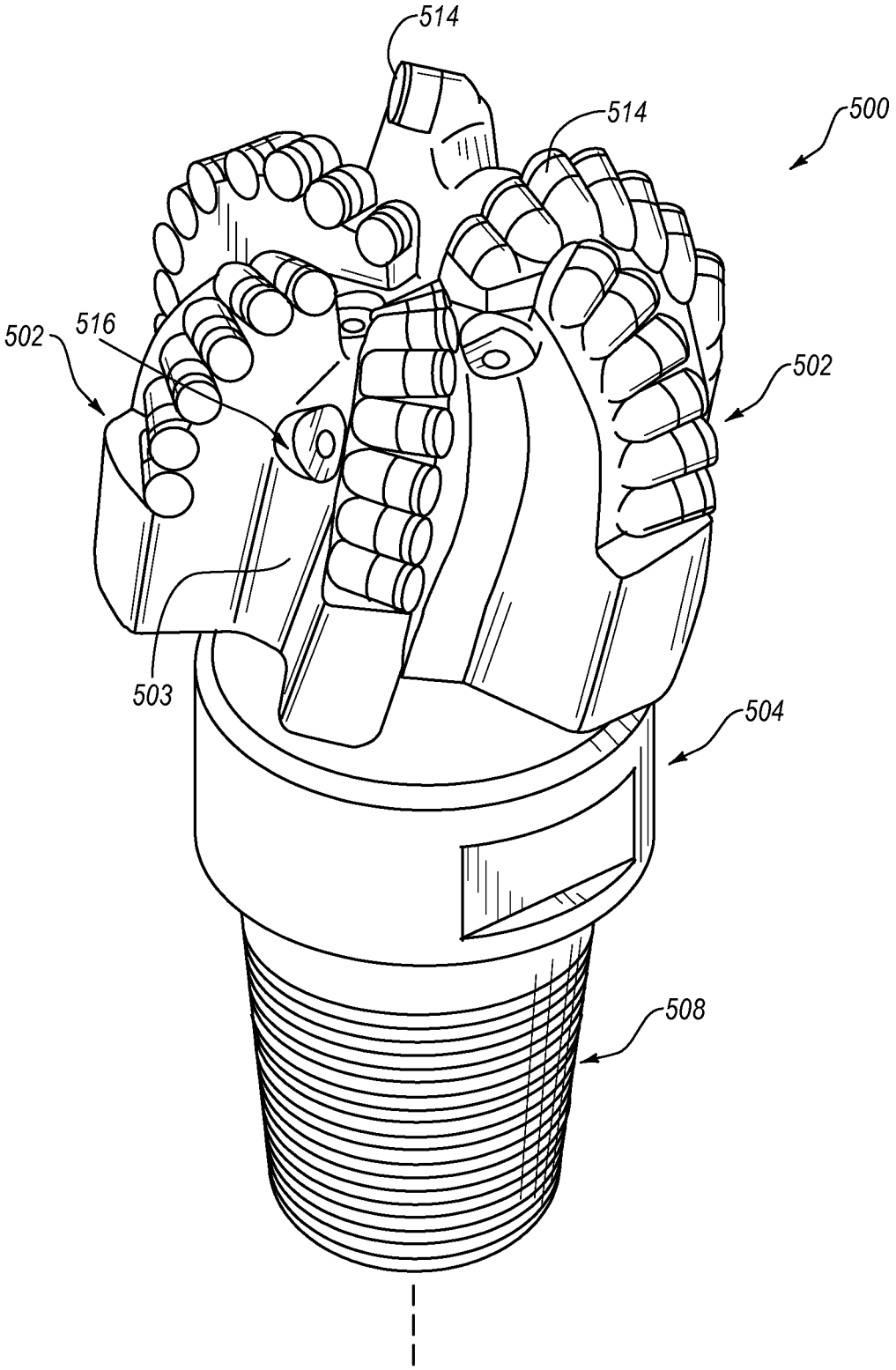
FIG. 5 illustrates a PCD rotary drill bit including an infiltrated diamond body in accordance with one or more implementations of the present invention.

The drilling tools shown and described in relation to FIGS. 2 and 4 have been coring drilling tools. One will appreciate that the diamond infiltrated bodies of the present invention can be used to form other non-coring drilling tools or non-drilling tools as described above. For example, FIG. 5 illustrates a drag drill bit 500 including one or more infiltrated diamond bodies. In particular, FIG. 5 illustrates a plurality of blades 502 and a bit body 503 formed from infiltrated diamond bodies. Each of the blades 502 can include one or more PCD cutters 514 or other cutter brazed or soldered to the blades 514. The drag drill bit 500 can further include a shank 504 and a first end 508 similar to those described herein above. One will appreciate the crown 402 and blades 502 shown in FIGS. 4 and 5 can have an increased drilling life due to the increased wear resistance provided by the diamond infiltrated bodies used to form them. This can allow a driller to replace the cutters 414, 514 multiple times before having to replace the drill bits 400, 500.

As shown by FIG. 5, the infiltrated diamond bodies can allow for the creation of bit bodies 503 and blades 502 with various features that may be difficult to create using other more traditional bit body compositions. For example, FIG. 5 illustrates that the infiltrated diamond bit body 503 can include holes 516 for nozzles and blades 502. Similarly, the blades 502 can include recesses for mounting the cutters 514 therein.

One will appreciate that the tools (such as 200, 400, 500) formed in whole or in part from infiltrated diamond bodies 100, 100*a* can be used with almost any type of machine or system in which wear resistance is needed or desired. For example, as mentioned above, the infiltrated diamond bodies 100, 100*a* can form in whole or in part any number of tools including, but not limited to, the tools described herein above. For example, FIG. 6, and the corresponding text, illustrate or describe one such drilling system with which tools of the present invention can be used. One will appreciate, however, the drilling system shown and described in FIG. 6 is only one example of a system with which tools including infiltrated diamond bodies of the present invention can be used.

Figure 6:
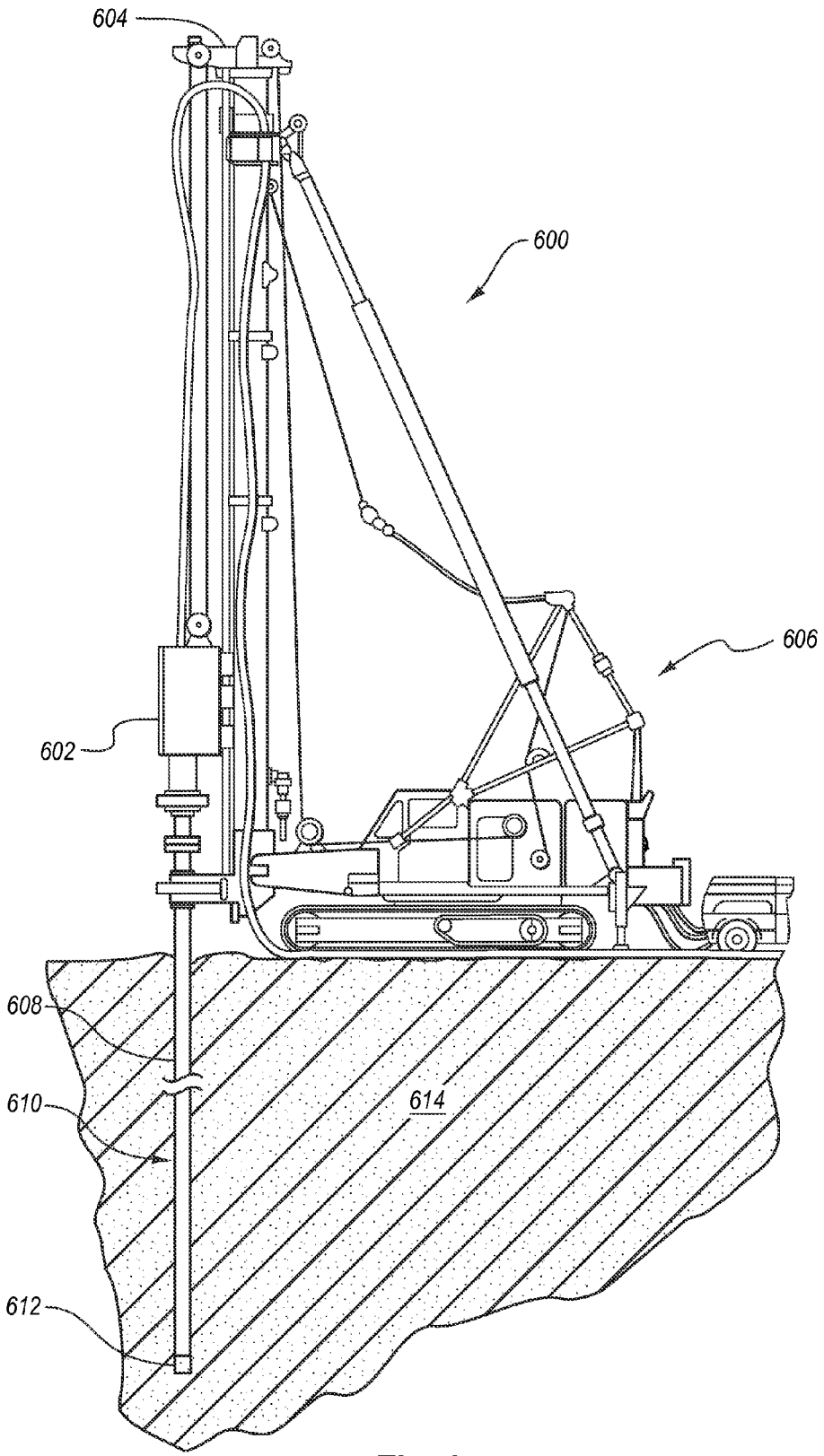
FIG. 6 illustrates a drilling system having a drilling tool with an infiltrated synthetic diamond body according to an implementation of the present invention.

Specifically, FIG. 6 illustrates a drilling system 600 that includes a drill head 602. The drill head 602 can be coupled to a mast 604 that in turn is coupled to a drill rig 606. The drill head 602 can be configured to have one or more drill string component 608 coupled thereto. The drill string component 608 can include, without limitation, drill rods, casings, reaming shells, and down-the-hole hammers. The drill string components 608 can in turn be coupled to additional drill string components 608 to form a drill or tool string 610. One or more of the drill string components 608 can include one or more infiltrated diamond bodies. For example, one or more of the drill string components 608 can include one or more pads 202 formed in whole or in part from an infiltrated diamond body 100. Alternatively, or additionally, one or more of the drill string components 608 can include an infiltrated diamond substrate 100*a* secured about an outer surface thereof. In any event one will appreciate that the infiltrated diamond bodies 100, 100*a* can increase the wear resistance of the drill string components 608.

The drill string 610 can be coupled to a drill bit 612 including one or more infiltrated diamond bodies 100, 100*a*, such as the drill bits 500 and 400 described hereinabove. As alluded to previously, the drill bit 612 including infiltrated diamond bodies 100, 100*a* can be configured to interface with the material 614, or formation, to be drilled.

In at least one example, the drill head 602 illustrated in FIG. 6 can be configured rotate the drill string 610 during a drilling process. Specifically, the drilling system 600 can be configured to apply a generally longitudinal downward force to the drill string 610 to urge the drill bit 612 or other tools including infiltrated diamond bodies 100, 100*a* into the formation 614 during a drilling operation. For example, the drilling system 600 can include a chain-drive assembly that is configured to move a sled assembly relative to the mast 604 to apply the generally longitudinal force to the drill bit 600.

As used herein the term "longitudinal" means along the length of the drill string 610. Additionally, as used herein the terms "upper," "top," and "above" and "lower" and "below" refer to longitudinal positions on the drill string 610. The terms "upper," "top," and "above" refer to positions nearer the mast 604 and "lower" and "below" refer to positions nearer the drill bit 612.

Thus, one will appreciate in light of the disclosure herein, that the tools of the present invention can be used for various purposes known in the art. For example, one or more drill string components 608 and a drill bit 600 each including one or more infiltrated diamond bodies 100, 100*a* can be attached to the end of the drill string 610, which is in turn connected to a drilling machine or rig 606. As the drill string 610 and the drill bit 600 are rotated and pushed by the drilling machine 606, cutters 414, 514 on the drill bit 600 or the drill bit itself can grind away the materials in the subterranean formations 614 that are being drilled. The wear resistance of the tools including infiltrated diamond bodies 100, 100*a* can last longer and require replacement less often.

Figure 7:
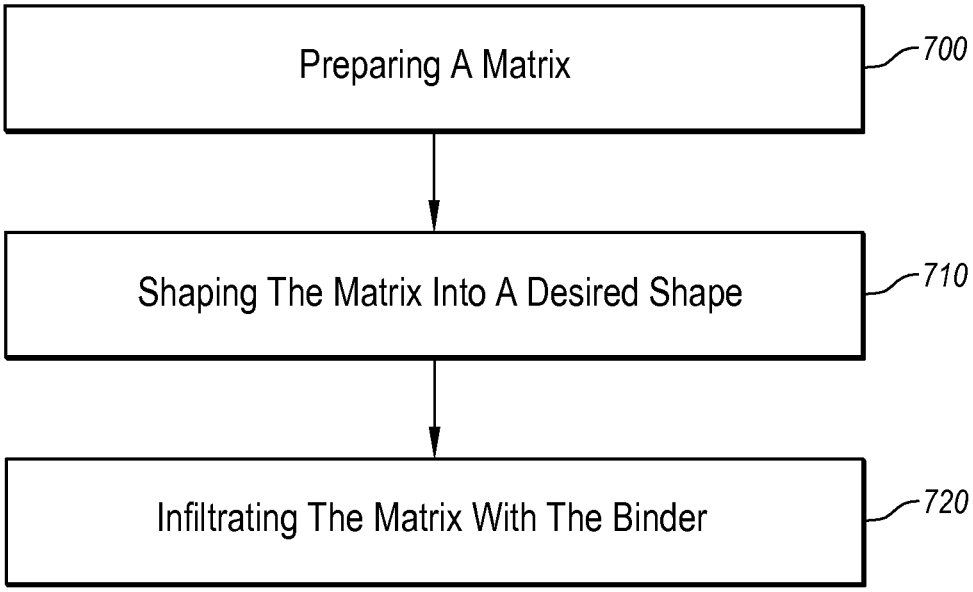
FIG. 7 a chart of acts and steps in a method of forming a tool having an infiltrated synthetic diamond body in accordance with an implementation of the present invention.

Implementations of the present invention also include methods of forming tools including infiltrated diamond bodies. The following describes at least one method of forming tools including infiltrated diamond bodies. Of course, as a preliminary matter, one of ordinary skill in the art will recognize that the methods explained in detail can be modified. For example, FIG. 7 illustrates a flowchart of one exemplary method for producing a tool including infiltrated diamond bodies using principles of the present invention. The acts of FIG. 7 are described below with reference to the components and diagrams of FIGS. 1 through 6.

As an initial matter, the term "infiltration" or "infiltrating" as used herein involves melting a binder material and causing the molten binder to penetrate into and fill the spaces or pores of a matrix. Upon cooling, the binder can solidify, binding the particles of the matrix together. The term "sintering" as used herein means the removal of at least a portion of the pores between the particles (which can be accompanied by shrinkage) combined with coalescence and bonding between adjacent particles.

For example, FIG. 7 shows that a method of forming a wear resistance tool comprise an act 700 of preparing a matrix. Act 700 can include preparing a matrix of diamond and a hard particulate material. For example, act 700 can comprise dispersing a plurality of diamond particles throughout a hard particulate material. More particularly, act 700 can involve preparing a matrix of a powered material, such as for example tungsten carbide, and dispersing diamond particles 102 therein. In additional implementations, the matrix can comprise one or more of the previously described hard particulate materials or diamond materials. Additionally, the method can involve dispersing the diamond 102 randomly or in an unorganized arrangement throughout the matrix. Act 700 can involve dispersing sufficient diamond 102 throughout the matrix such that the diamond 102 comprises at least 25 percent by volume of the matrix. In additional implementations, the matrix comprises between about 25% and 95% diamond.

FIG. 7 also shows that the method can comprise an act 710 of shaping the matrix into a desired shape. In one or more implementations of the present invention, act 710 can include placing the matrix in a mold. The mold can be formed from a material that is able to withstand the heat to which the matrix will be subjected to during a heating process. In at least one implementation, the mold may be formed from carbon. The mold can be shaped to form a tool having desired features. In at least one implementation of the present invention, the mold can correspond to a core drill bit, a reaming pad, or other tool.

FIG. 7 also shows that the method can comprise an act 720 of infiltrating the diamond matrix with a binder. Act 720 can involve heating the binder to a molten state and infiltrating the diamond matrix with the molten binder. For example, in some implementations the binder can be placed proximate the diamond matrix and the diamond matrix and the binder can be heated to a temperature sufficient to bring the binder to a molten state. At which point the molten binder can infiltrate the diamond matrix. In one or more implementations, act 720 can include heating the diamond matrix and the binder to a temperature of at least 787° F.

The binder can comprise copper, zinc, silver, molybdenum, nickel, cobalt, tin, iron, aluminum, silicon, manganese, or mixtures and alloys thereof. The binder can cool thereby bonding to the diamond 102 and the hard particulate material, thereby binding them together. According to one or more implementations of the present invention, the time and/or temperature of the infiltration process can be increased to allow the binder to fill-up a greater number and greater amount of the pores of the diamond matrix. This can both reduce the shrinkage during sintering, and increase the strength of the resulting tool.

The method can further comprise an act of cooling the infiltrated diamond matrix to form an infiltrated diamond body 110, 100*a*. The method can further involve securing the infiltrated diamond body 110, 100*a* to a tool or a portion thereof. For example, the method can involve securing a shank 204 to the infiltrated diamond body 110, 100*a*. For example, the method can involve placing a shank 204 in contact with the diamond matrix. A backing layer of additional matrix, binder material, and/or flux may then be added and placed in contact with the diamond matrix as well as the shank 204 to complete initial preparation of a green tool. Once the green tool has been formed, it can be placed in a furnace to thereby consolidate the tool. Thereafter, the tool can be finished through machine processes as desired.

Before, after, or in tandem with the infiltration of the diamond matrix, one or more methods of the present invention can include sintering the diamond matrix to a desired density. As sintering involves densification and removal of porosity within a structure, the structure being sintered can shrink during the sintering process. A structure can experience linear shrinkage of between 1% and 40% during sintering. As a result, it may be desirable to consider and account for dimensional shrinkage when designing tooling (molds, dies, etc.) or machining features in structures that are less than fully sintered.

Accordingly, the schematics and methods described herein provide a number of unique products that can be effective for drilling or other tools. Additionally, such products can have an increased wear resistance due to the relatively large concentration of diamond. The present invention can thus be embodied in other specific forms without departing from its spirit or essential characteristics. For example, the drill bits of one or more implementations of the present invention can include one or more enclosed fluid slots, such as the enclosed fluid slots described in U.S. patent application Ser. No. 11/610,680, filed Dec. 14, 2006, entitled "Core Drill Bit with Extended Crown Longitudinal dimension," now U.S. Pat. No. 7,628,228, the content of which is hereby incorporated herein by reference in its entirety. Still further, the impregnated drill bits of one or more implementations of the present invention can include elongated structures, such as the tapered waterways described in U.S. patent application Ser. No. 13/217,107, filed Aug. 24, 2011, entitled "Impregnated Drilling Tools Including Elongated Structures," the content of which is hereby incorporated herein by reference in its entirety. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A solidified infiltrated tool configured to be resistant to wear, wherein the solidified infiltrated tool is selected from the group consisting of a drill bit body, a wear pad, and a wear strip, the solidified infiltrated tool comprising:

a matrix having a hard particulate material and a plurality of diamond particles dispersed throughout the hard particulate material; and a binder comprising a copper-based infiltrant, wherein the diamond particles comprise between about 35 percent and about 75 percent by volume of the solidified infiltrated tool, and wherein the binder secures the hard particulate material and the diamond particles together, wherein the diamond particles comprise the largest component by volume of the solidified infiltrated tool, wherein the diamond particles are substantially homogenously dispersed throughout the solidified infiltrated tool, and wherein the diamond particles are configured to provide the primary defense against wear and erosion of the solidified infiltrated tool.

2. The solidified infiltrated tool as recited in claim 1, wherein the diamond particles comprise synthetic diamond crystals.

3. The solidified infiltrated tool as recited in claim 1, wherein the hard particulate material comprises tungsten carbide.

4. The solidified infiltrated tool as recited in claim 1, wherein the diamond particles comprise about 50 percent by volume of the solidified infiltrated tool.

5. The solidified infiltrated tool as recited in claim 1, wherein the diamond has a largest dimension of between about 0.01 millimeters to about 1.0 millimeters.

6. The solidified infiltrated tool as recited in claim 1, wherein the diamond has a largest dimension of more than about 2.0 millimeters.

7. The solidified infiltrated tool as recited in claim 6, wherein the diamond has a volume of more than about 8 $mm^3$.

8. The solidified infiltrated tool as recited in claim 1, wherein the binder comprises between about 20 percent and about 45 percent by volume of the solidified infiltrated tool.

9. The solidified infiltrated tool as recited in claim 1, wherein the solidified infiltrated tool is the drill bit body.

10. The solidified infiltrated tool as recited in claim 9, further comprising a plurality of cutters secured to the solidified infiltrated drill bit body.

11. The solidified infiltrated tool as recited in claim 1, wherein the solidified infiltrated tool is the wear pad.

12. The solidified infiltrated tool as recited in claim 1, wherein the solidified infiltrated tool is the wear strip.

13. A method of forming a wear resistant tool, comprising:

preparing a matrix by dispersing a plurality of diamond particles throughout a hard particulate material;

shaping the matrix into a desired shape; and infiltrating the matrix with a binder material, wherein the binder material comprises a copper-based infiltrant and secures the hard particulate material and the diamond particles of the matrix together to form an infiltrated tool, wherein the infiltrated tool is selected from the group consisting of a drill bit body, a wear pad, and a wear strip, and wherein, following solidifying of the infiltrated tool, the diamond particles comprise the largest component by volume of the infiltrated tool and comprise between about 35 percent and about 75 percent by volume of the infiltrated tool, wherein the diamond particles are substantially homogenously dispersed throughout the infiltrated tool, and wherein the diamond particles are configured to provide the primary defense against wear and erosion of the infiltrated tool.

14. The method as recited in claim 13, wherein the diamond particles comprise synthetic diamond crystals.

15. The method as recited in claim 13, wherein shaping the matrix comprises placing the matrix within a mold.

16. The method as recited in claim 13, wherein the solidified infiltrated tool is the drill bit body.

17. The method as recited in claim 16, further comprising securing a plurality of cutters to the solidified infiltrated drill bit body.

18. The method as recited in claim 13, wherein the solidified infiltrated tool is the wear pad.

19. The method as recited in claim 13, wherein the solidified infiltrated tool is the wear strip.

20. A wear resistant drilling tool, comprising:

a shank having a first end and a second end, the first end of the shank comprising a threaded connector; and a solidified infiltrated drill bit body secured to the shank, the solidified infiltrated drill bit body comprising a matrix, the matrix comprising a hard particulate material, diamond, and a binder, wherein the diamond comprises between about 35 percent and about 75 percent by volume of the solidified infiltrated drill bit body, wherein the binder secures the hard particulate material and the diamond particles of the matrix together and is configured to prevent erosion of the solidified infiltrated drill bit body during drilling, wherein the diamond comprises the largest component by volume of the solidified infiltrated drill bit body, wherein the diamond is substantially homogenously dispersed throughout the solidified infiltrated drill bit body and wherein the diamond is configured to provide the primary defense against wear and erosion of the solidified infiltrated drill bit body.

21. The drilling tool as recited in claim 20, wherein the diamond comprises synthetic diamonds particles.

22. The drilling tool as recited in claim 20, further comprising a plurality of cutters secured to the solidified infiltrated drill bit body.

23. The drilling tool as recited in claim 20, wherein the diamond comprises about 50% by volume of the solidified infiltrated drill bit body.

* * * * *